US006588734B2

(12) United States Patent
Redner et al.

(10) Patent No.: US 6,588,734 B2
(45) Date of Patent: Jul. 8, 2003

(54) HUMIDIFIER WITH SWINGABLE COVER

(75) Inventors: Carl R. Redner, Hartland, MI (US); Richard J. Lutty, Jr., Brighton, MI (US)

(73) Assignee: General Filters, Inc., Novi, MI (US)

( * ) Notice: Subject to any disclaimer, the term of this patent is extended or adjusted under 35 U.S.C. 154(b) by 76 days.

(21) Appl. No.: 09/989,673

(22) Filed: Nov. 21, 2001

(65) Prior Publication Data

US 2003/0094712 A1 May 22, 2003

(51) Int. Cl.[7] ..... B01F 3/04

(52) U.S. Cl. ..... 261/106; 261/DIG. 15; 126/113

(58) Field of Search ..... 261/66, 106, 107, 261/97, DIG. 15, DIG. 41; 126/113

(56) References Cited

U.S. PATENT DOCUMENTS

| | | | | | |
|---|---|---|---|---|---|
| 3,491,746 | A | * | 1/1970 | Swimmer et al. | |
| 3,861,894 | A | | 1/1975 | Marsh | |
| 3,898,976 | A | * | 8/1975 | Coffman, Jr. | 126/113 |
| 3,975,470 | A | | 8/1976 | Engel | |
| 4,125,576 | A | | 11/1978 | Kozinski | |
| 4,158,679 | A | | 6/1979 | Yeagle | |
| 4,200,598 | A | * | 4/1980 | Yeagle | 126/113 |
| 4,361,523 | A | * | 11/1982 | Shepherd | 261/DIG. 15 |
| 5,252,260 | A | * | 10/1993 | Schuman | 261/106 |
| 5,593,481 | A | | 1/1997 | Redner | |
| 5,765,544 | A | * | 6/1998 | Vigansky, Jr. | 261/106 |
| 5,851,444 | A | * | 12/1998 | Hansell, Jr. et al. | 261/106 |
| 5,965,068 | A | * | 10/1999 | Williamson et al. | 261/DIG. 15 |
| 6,354,572 | B1 | * | 3/2002 | Menassa | 261/106 |
| 2002/0171158 | A1 | * | 11/2002 | Bloemer | 261/97 |

* cited by examiner

*Primary Examiner*—C. Scott Bushey
(74) *Attorney, Agent, or Firm*—Dykema Gossett PLLC

(57) ABSTRACT

The humidifier includes a cabinet having a rear wall, a front wall, a pair of side walls, a bottom wall and a sump defined in part by the walls at the bottom of the cabinet. The cabinet has in the interior thereof means providing communication with an air system. Retainer ears are provided on the outer surfaces of the side walls near the top thereof. An evaporator pad is mounted in the cabinet adjacent and parallel to the rear wall. A water distribution trough is disposed in the interior of the cabinet adjacent the rear wall and is located above the evaporator pad for providing a substantially uniformly distributed flow of water to the evaporator pad. A pair of mounting elements are provided on the inner surfaces of the side walls near the bottom thereof. A swingable cover is provided for opening and closing the cabinet and has a top end and a bottom end. The cover at the bottom end is provided with a pair of bearing portions which are engageable with and pivotally mounted on the mounting elements. Fastening means are secured to the sides of the top end of the cover and are engageable with the retainer ears when the cabinet is closed. The cover when the fastening means are disengaged from the retainer ears being swingable relative to the mounting elements for opening the cover to permit access to the evaporator pad and to the interior of the cabinet.

6 Claims, 3 Drawing Sheets

HUMIDIFIER WITH SWINGABLE COVER

BACKGROUND OF THE INVENTION

1. Field of the Invention

The humidifier is for use with an air system and is especially adapted for installation on a forced air furnace.

2. Description of the Prior Art

The effective distribution of water to the evaporator pad of a humidifier is an important consideration in the design of the humidifier. It is highly desirable that the water be uniformly disbursed over the entire pad area. It is also desirable that the distribution of the water remain uniform despite slight errors in the mounting of the humidifier. The humidifier should be mounted in a perfectly level position although such a condition is not always achieved in practice. The water distribution means must be capable of providing substantially uniform distribution of the water to the evaporator pad even though the humidifier is not perfectly level.

Humidifiers for use with an air system such as a forced air furnace is shown in several expired patents assigned to the assignee of record including the Engel, U.S. Pat. No. 3,975,470, issued Aug. 17, 1976; Kozinski, U.S. Pat. No. 4,125,576 issued Nov. 14, 1978 and the Yeagle U.S. Pat. No. 4,158,679 issued Jun. 19, 1979. Such prior art patents include and describe the use of water distribution troughs which are mounted directly above the evaporator pad and ensure that the water is uniformly distributed to the evaporator pad. With such prior art humidifiers, it is difficult and time consuming to access the evaporator pads and the water distribution troughs. The present invention solves that problem by providing a humidifier with a swingable cover which is easy to open and close.

SUMMARY OF THE PRESENT INVENTION

It is a feature of the present invention to provide a humidifier with a swingable cover which is adapted to be connected to an air system comprising a unitary cabinet having a rear wall, a front wall, a pair of side walls, a bottom wall and a drain sump defined in part by said walls and located at the bottom of the cabinet.

Another feature of the present invention is to provide a humidifier of the aforementioned type wherein a swingable cover is attached to the cabinet at the front and near the bottom thereof and is designed to open and close the cabinet.

Still another feature of the present invention is to provide a humidifier of the aforementioned type wherein the cabinet is provided with retainer ears on the outer surfaces of the side walls near the top thereof and an evaporator pad is mounted in the cabinet adjacent and parallel to the rear wall. With such a construction, a water distribution trough is disposed in the interior of the cabinet adjacent the rear wall and is located above the evaporator pad for providing a substantially uniformly distributed flow of water to the evaporator pad.

A further feature of the present invention is to provide a humidifier of the aforementioned type wherein a pair of mounting elements are provided on the inner surfaces of the side walls of the cabinet near the bottom thereof and the swingable cover at the bottom end is provided with a pair of bearing portions which are engageable with and pivotally mounted on the mounting elements.

A still further feature of the present invention is to provide a humidifier of the aforementioned type wherein fastening means are secured to the sides at the top end of the cover and are engageable with the retainer ears when the cabinet is closed, with the cover when the fastening means are disengaged from the retainer ears being swingable relative to the mounting element for opening the cover to permit access to the evaporator pad and trough and to the interior of the cabinet.

Another feature of the present invention is to provide a humidifier of the aforementioned type wherein the rear wall is provided with an opening which is adapted to be connected to the warm or return air plenum of the forced air furnace.

Still another feature of the present invention is to provide a humidifier of the aforementioned type wherein a pair of openings are provided in the side walls, with one opening in one side wall being adapted to be connected to the warm or return air plenum and a bypass cover being removably located in the other opening of the other side wall for closing same. With such a construction the humidifier may be mounted for either a left hand or right hand bypass connection.

A further feature of the present invention is to provide a humidifier of the aforementioned type wherein the bypass cover is provided with a pair of brackets which are engageable with portions of the side wall in which the cover is inserted for retaining the bypass cover in the opening thereby closing same.

A still further feature of the present invention is to provide a humidifier of the aforementioned type wherein an opening is provided in the cover near the top end thereof, said opening having a first dimension and a second dimension and a solenoid valve having a mounting element insertable into said cover opening and thereafter rotatable in said cover opening 900 to locate and to lock the solenoid valve on the cover.

The use of the swingable cover has many advantages in that it permits easy access to the evaporator pad even if the cover is obstructed. Also, the cover may be closed due to the snap action mechanism provided on the top end of the cover which is engageable with the retaining elements provided on the cabinet. In addition, only ¼ or 90° turn of the solenoid valve is required to remove it from the cabinet so that the valve may be serviced or repaired. Further, the cabinet may be opened by swinging the cover about the bearing means without removing the wires to which the valve is attached or removing the water line. In addition, no tools or fasteners are required to install or to remove the bypass cover from the opening in the cabinet.

Another feature of the present invention is to provide a humidifier of the aforementioned type which is simple in construction, is economical to manufacture and is efficient in operation.

DESCRIPTION OF A PREFERRED EMBODIMENT

Figure 1:
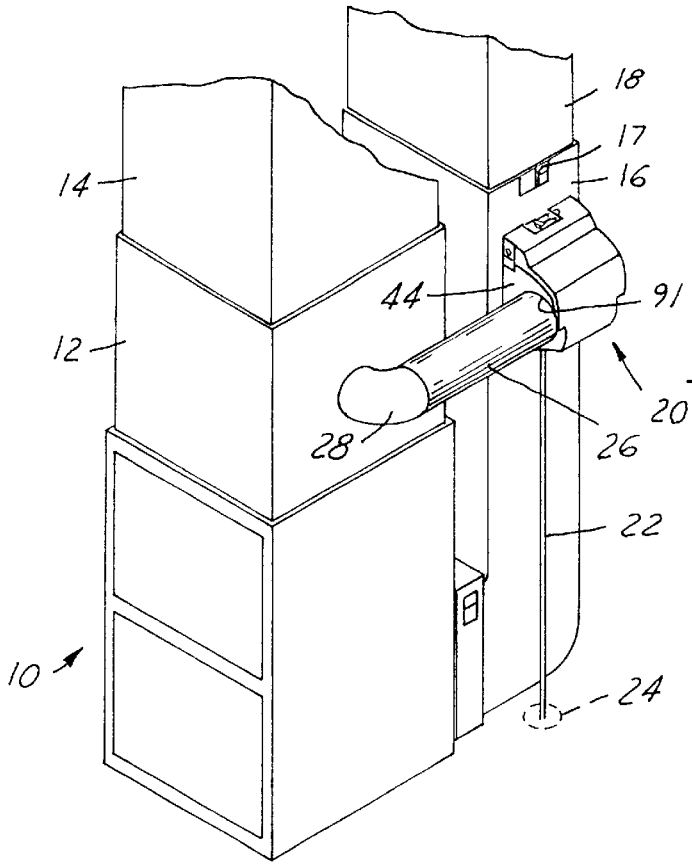
FIG. 1 is a perspective view of an air treating system with the humidifier mounted on the return air plenum of the system.

FIG. 1 shows an air treating apparatus or furnace 10 such as a forced air furnace having the usual warm air plenum 12 and warm air duct 14 and a return air plenum 16 with a return air duct 18. The flow through bypass humidifier 20 to which the present invention is directed may be mounted on either the warm air plenum 12 or, as shown in FIG. 1, on the return air plenum with equal efficiency. The humidifier 20 includes a drain sump which is connected by a line 22 to the drain 24 provided in the floor. A bypass pipe 26 connects the flow through humidifier 20 from an elbow 28 which directs the air from the warm air plenum 12 into the humidifier. The operating principal of the humidifier is based on the most efficient and economical means of evaporating water to the air. The humidifier 20 uses only five watts of electrical power during operation. The heat necessary for evaporating the waters is produced by the furnace 10.

Figure 2:
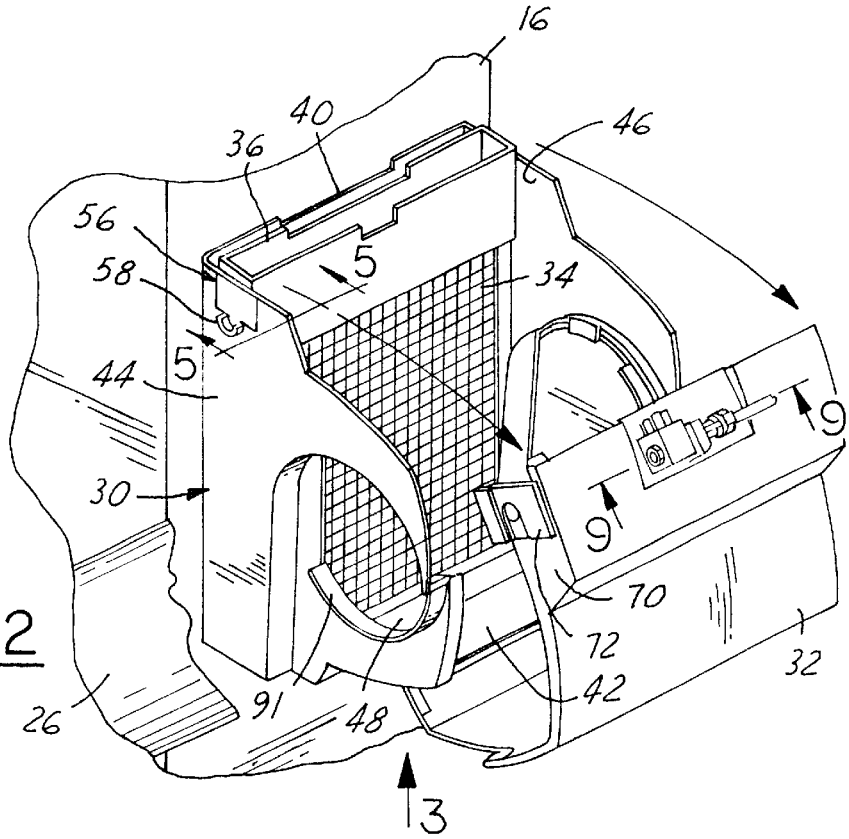
FIG. 2 is a perspective view of the humidifier, with the cabinet open and the cover unlatched to expose the interior of the cabinet.

The humidifier 20 comprises a unitary housing or cabinet 30, a swingable cover 32, an evaporator pad 34 located within the housing or cabinet 30, a water distribution trough or tray 36 removably mounted on the top of the pad 34 within the housing 30 as shown in FIG. 2.

The cabinet 30 has a rear wall 40, a relatively short front wall 42, a pair of side walls 44 and 46, a bottom wall 48 and a sump 50 defined in part by said walls. A drain spout 52 for the sump 50 is located exteriorly of the cabinet 30 and is connected by the tubing 22 to the drain 24.

Figure 3:
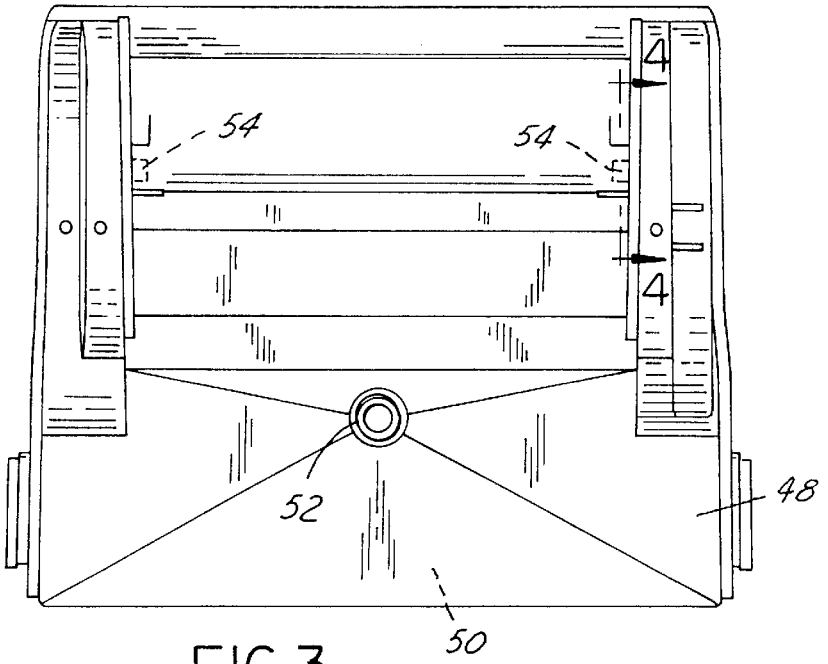
FIG. 3 is a bottom view of the humidifier showing the drain opening for the drain sump.

Each side wall 44, 46 is provided with a mounting element 54 (FIGS. 3 and 4) which are provided on the inner surfaces of the side walls near the bottom of the cabinet 30. The outside surfaces of the side walls 44, 46 are each provided with a retainer plate 56 having an ear 58.

Figure 4:
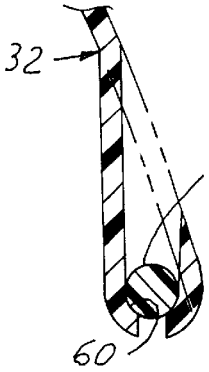
FIG. 4 is a fragmentary sectional view taken on the line 4—4 of FIG. 3 and showing the bearing portion of the cover engageable with and pivotally mounted on a corresponding mounting element of the cabinet.

The swingable cover 32 at the lower edge thereof is cut away and shaped to provide bearing portion 60 which is designed to fit over and to pivot on the bearing portions 54 as best illustrated in FIG. 4. The cover 32 may be removed when required from the bearings 54 to permit cleaning of the interior of the cabinet 30.

Figure 7:
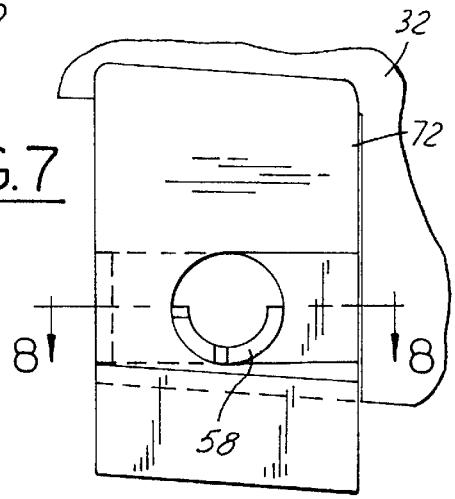
FIG. 7 is a fragmentary side view taken on the line 7—7 of FIG. 5 showing the cover fastening means engaged with the corresponding retainer ear provided on the cabinet.
Figure 5:
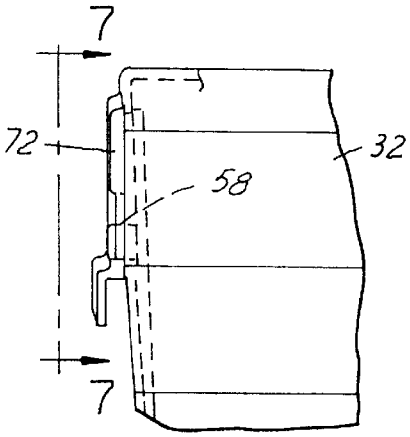
FIG. 5 is a fragmentary view of the cabinet taken on the line 5—5 of FIG. 2 and illustrating the fastening means provided on the swingable cover for engagement with the retainer ear provided on the cabinet.
Figure 6:
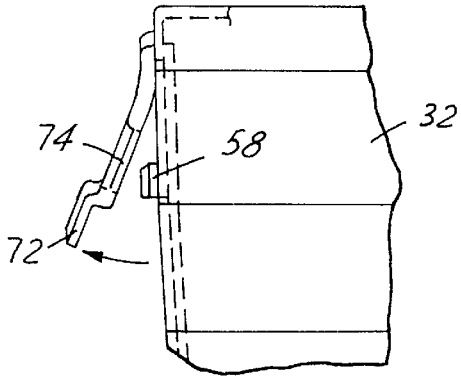
FIG. 6 is a view similar to FIG. 5, with the cover fastening means unattached to the corresponding retainer ear provided on the cabinet.
Figure 8:
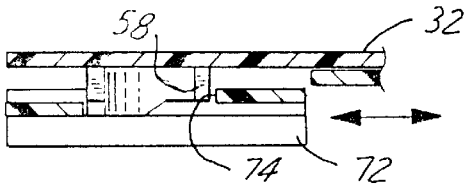
FIG. 8 is a fragmentary sectional view taken on the line 8—8 of FIG. 7.

The cover 32 has side surfaces 70 to which are connected fastening means or clips 72. The clips 72 are provided with a latch opening 74 which is designed to fit over and catch the retainer 58 provided on the side walls 44, 46 of the cabinet 30. The fastening clips or fastening means 72 are engageable with the retainer ears 58 when the cabinet 30 is closed as illustrated in FIGS. 5, 7 and 8. The evaporator pad 34 is supported upright within the cabinet 30 between an opening provided in the rear wall 40, which is in communication with the return air plenum 16, and the opening provided in the side wall 44 which is connected to the bypass pipe 26. Accordingly, air moving through the system must flow through the evaporator pad 34 to pick up moisture contained therein. The evaporator pad 34 may be formed of any suitable construction and normally is made of a foraminous material having numerous small though unobstructed passages adapted to retain water by capillary to be picked up by air moving through it.

The evaporator pad is seated within the drain sump 50 of the cabinet 30. The water distribution trough 36 has a depending rectangular skirt or shroud which surrounds the upper edge portions of the evaporator pad 34 as illustrated in FIG. 2. The shroud or skirt stabilizers the evaporator pad 34 and holds it upright and also prevents the water dripping from the water trough 36 from being deflected away from the pad 34 by the air flow through the humidifier 20. The trough 36, as in the prior art patents identified previously, has an upstanding target element and channels leading to the various apertures of the trough 36 provided over the pad 34 throughout the length of the trough. In use, the humidifier 20 is mounted as shown in FIG. 1 with care so that the bottom of the trough 36 is horizontal. In this way, an equal distribution of water through the various apertures will be assured. However, because of the construction of the target element and the channels leading to the various notches, any slight departure from horizontal will not particularly affect the uniform distribution of water to the evaporator pad. A further explanation of the operation and functioning of the water distribution trough 36 may be obtained by referring to prior art patents mentioned previously, as an example, U.S. Pat. No. 4,125,576.

Figure 9:
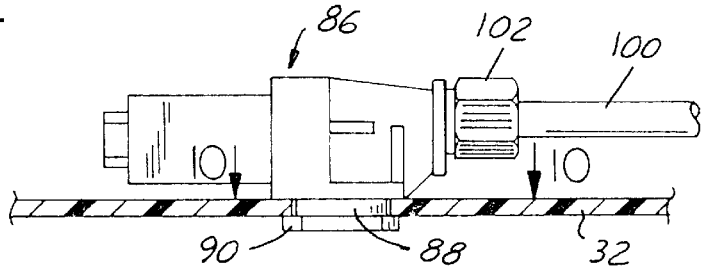
FIG. 9 is a view of the upper end of the swingable cover showing a removable solenoid valve with an extension mounted in an opening provided in the cover.
Figure 10:
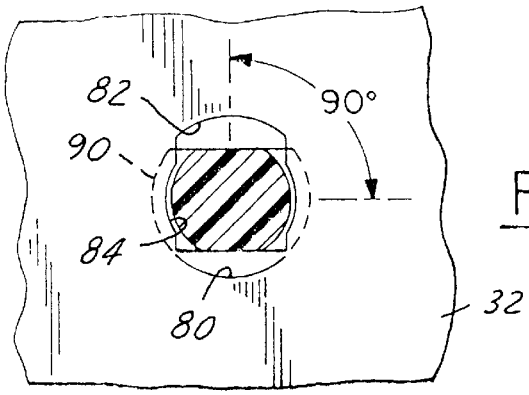
FIG. 10 is a view, partly in section, taken on the line 10—10 of FIG. 9 and showing the manner in which the solenoid valve may be rotated 90° in order to remove the valve from the cover.

The leading or front edge of the cover 32, as illustrated in FIGS. 9 and 10, is provided with an irregular shaped opening 80 having a first dimension 82 and a second dimension 84 which is smaller than the first dimension 82. A solenoid valve assembly 86 is provided on the lower surface thereof with a stem 88 having a rim 90 secured to the outer end thereof. The solenoid valve assembly 86 is inserted into the opening 80 provided in the cover 32 so that the rim 90 will fit through the opening in the cover defined by the first dimension 82. Thereafter the solenoid valve assembly 86 is rotated 90° to move the rim 90 underneath the cover 32 as best shown in FIG. 10. The solenoid valve 86 may be released quickly by turning the solenoid valve assembly 86 through 90° in order to thereafter remove or separate the solenoid valve assembly 86 from the cover 32.

Figure 11:
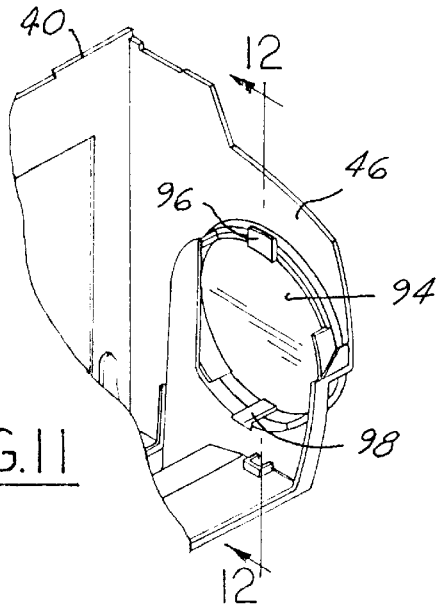
FIG. 11 is a fragmentary perspective view of the cabinet illustrating a bypass cover provided in one of the side walls thereof to close the opening provided therein.
Figure 12:
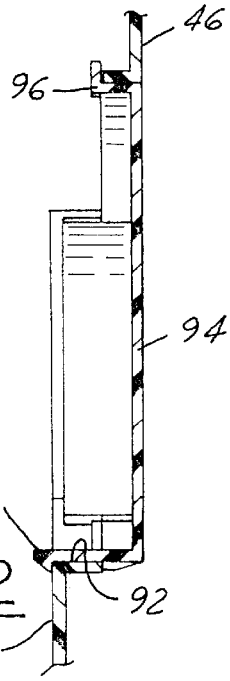
FIG. 12 is a sectional view taken on the line 12—12 of FIG. 11 and illustrating the manner in which the brackets provided on the bypass cover engage the side wall to close the opening.

Side wall 44 is provided with an opening 91 and side wall 46 is provided with an opening 92. The galvanized bypass pipe 26 mounted in the opening 91 of side wall 44 as shown in FIG. 1. The other side wall 46, with the opening 92 provided therein, is closed by the insertion of a bypass cover 94 having a pair of brackets 96 and 98 which grip portions of the side wall 46 as best illustrated in FIGS. 11 and 12. No tools or fasteners are required to install the bypass cover 94.

The water supply tube 100 has its discharge end controlled by the solenoid valve assembly 86 in order to deliver water to the target of the water distribution trough 36. The tube 100 is connected to a potable water system (not shown) for supplying water under pressure. The fitting 102 connects the tube 100 to the solenoid valve assembly 86. The solenoid valve 86 may be connected with the blower circuit of the furnace 10 so as to open when the furnace blower is on and closed when the blower is off. A humidistat 17 may be connected in series with the solenoid valve assembly 86 to provide automatic control of the relative humidity in the humidified air space.

Water flows through a strainer forming part of the solenoid valve assembly 86 and is metered through an orifice to provide the proper amount of water which is supplied to the evaporator pad 34 by the distributor trough 36. Moisture is evaporated by the air passing through the evaporator pad 36.

When it is required to replace the evaporator pad 34 and/or clean the trough 36, the cover 32 is released from the retainer ears 58 provided on the side walls of the cabinet 30. Thereafter, the swingable cover 32 is moved to the open position shown in FIG. 2 thereby exposing the interior of the cabinet 30 allowing easy access to the evaporator pad 34 and to the trough 36. Access is permitted to the pad 34 even if the cover 32 may be in an obstructed location. Cover 32 may be opened as shown in FIG. 2 without removal of the wires for the solenoid valve and the water line 100. After repair or cleaning of the humidifier 20 has been completed and the evaporator pad 34 and trough 36 installed in the cabinet 30, the cover 32 can be closed, with the fastening means 72 re-engaging the retainer ears 58 provided on the cabinet 30.

The housing or cabinet 30 and the cover 32 are made from a light weight high temperature thermoplastic.

What we claim is:

1. A humidifier adapted to be connected to an air system comprising a cabinet having a rear wall, a front wall, a pair of side walls, a bottom wall and a sump defined in part by said walls at the bottom of the cabinet, said cabinet having in the interior thereof means providing communication with the air system, retainer ears on the outer surfaces of said side walls near the top thereof, an evaporator pad mounted in said cabinet adjacent and parallel to said rear wall, a water distribution trough disposed in the interior of said cabinet adjacent said rear wall and located above said evaporator pad for providing a substantially uniformly distributed flow of water to said evaporator pad, a pair of mounting elements provided on the inner surfaces of said side walls near the bottom thereof, a swingable cover for opening and closing said cabinet and having a top end and a bottom end, said cover at said bottom end being provided with a pair of bearing portions which are engageable with and pivotally mounted on said mounting elements, and fastening means secured to the sides of the top end of said cover and engageable with said retainer ears when said cabinet is closed, said cover when said fastening means are disengaged from said retainer ears being swingable relative to said mounting elements for opening said cover to permit access to said evaporator pad and to the interior of said cabinet.

2. The humidifier defined in claim 1 wherein at least the rear wall is provided with an opening adapted to be connected to the warm or return air plenum.

3. The humidifier defined in claim 1 wherein a pair of openings are provided in said side walls, with one opening in one side wall being adapted to be connected to the warm or return air plenum, and a bypass cover removably located in the other opening of the other side wall for closing same.

4. The humidifier defined in claim 3 wherein said bypass cover is provided with a pair of brackets engageable with portions of said other side wall for retaining said bypass cover in said other opening thereby closing same.

5. The humidifier defined in claim 1 wherein an opening is provided in the cover near the top end thereof, said opening having a first dimension and a second dimension, and a solenoid valve having a mounting element insertable into said opening and thereafter rotatable in said opening 90° to locate and to lock said solenoid valve on said cover.

6. The humidifier defined in claim 1 wherein said housing and said swingable cover are made from a high temperature thermoplastic material.

* * * * *